US009330551B2

(12) United States Patent
Lee

(10) Patent No.: US 9,330,551 B2
(45) Date of Patent: May 3, 2016

(54) APPARATUS OF MONITORING ELECTRICAL FIRE FOR POWER DISTRIBUTION PANNELS

(71) Applicant: SeoungChoul Lee, Daejeon (KR)

(72) Inventor: SeoungChoul Lee, Daejeon (KR)

( * ) Notice: Subject to any disclaimer, the term of this patent is extended or adjusted under 35 U.S.C. 154(b) by 72 days.

(21) Appl. No.: 14/314,074

(22) Filed: Jun. 25, 2014

(65) Prior Publication Data

US 2015/0009036 A1 Jan. 8, 2015

(30) Foreign Application Priority Data

Jul. 2, 2013 (KR) ..... 10-2013-0076788

(51) Int. Cl.
*G08B 17/10* (2006.01)
*G08B 17/103* (2006.01)

(52) U.S. Cl.
CPC ..... *G08B 17/103* (2013.01)

(58) Field of Classification Search
None
See application file for complete search history.

(56) References Cited

FOREIGN PATENT DOCUMENTS

KR 10-0981232 B1 9/2010
WO WO 2005-026705 A1 3/2005

*Primary Examiner* — Fekadeselassie Girma
*Assistant Examiner* — Thomas McCormack
(74) *Attorney, Agent, or Firm* — Rabin & Berdo, P.C.

(57) ABSTRACT

An early electrical fire sensing system for a high voltage panel, a low voltage panel, a motor control panel, a distribution board, or a power distribution panel comprises the first laser that emits the frequency beam absorbed by benzyl alcohol gas and the first detecting device which detects the first beam intensity; the second laser which emits the frequency beam absorbed by BHT gas and the second detecting device which detects the second laser beam intensity; and a main control unit which consists of a microprocessor. The main control unit gives a fire alarm event when the first laser beam intensity of the first detecting device is decreased more than a reference value, while a fire emergent alarm event when the second laser beam intensity of the second detecting device is decreased more than a reference value.

5 Claims, 6 Drawing Sheets

APPARATUS OF MONITORING ELECTRICAL FIRE FOR POWER DISTRIBUTION PANNELS

BACKGROUND OF THE INVENTION

1. Field of the Invention

The present invention relates to an early electrical fire sensing system for a high voltage panel, a low voltage panel, a motor control panel, a distribution board, or a power distribution panel. The early electrical fire sensing system monitors the laser beam intensity of the particular frequencies absorbed by benzyl alcohol gas or BHT (butyl hydroxyl toluene) gas, which commonly comes out from electrical insulating materials of the panels due to overheating.

2. Description of the Related Art

Power distribution panels for distributing the electrical power to facilities are installed in factories and buildings. Electrical power wires, circuits and circuit boards are protected by mostly organic insulating materials. However, there is a risk of fire due to overheating of the organic insulating materials by neglecting structural defects, construction defects, aging of facility, and poor contact, etc.

Recently, the ratio of the electrical fires to the occurred fires of the panels is increasing due to leakage, short, and insulation aging of electrical facilities.

Conventional methods for sensing of electrical fires use a heat sensor for detecting a rise in temperature or an ignition source of the panel or a smoke detector for sensing the presence of smoke to activate fire extinguishing system. However, the detection of the ignition source or the smoke means that a fire occurred already.

Therefore, it is necessary for an early sensing and prompt warning of electrical fires before fire occurs.

Korea registered patent 10-0981232 discloses a fire sensing method that provides an early electrical fire warning system by comparing a measured value of an inner sensor with that of a standard sensor for monitoring electrical fires and equipment failure in a power distribution panel. In addition, International published patent WO2005026705 discloses a gas detector which employs vertical cavity surface emitting lasers diodes.

SUMMARY OF THE INVENTION

The present invention provides an early electrical fire sensing system for a high voltage panel, a low voltage panel, a motor control panel, a distribution board, or a power distribution panel.

An early electrical fire sensing system comprises followings: the first laser emitting with the first frequency beam absorbed by benzyl alcohol gas and the first detecting device detecting the first laser beam intensity; the second laser emitting with the second frequency beam absorbed by BHT gas and the second detecting device detecting the second laser beam intensity; and a main control unit consisting of a microprocessor, wherein one of the laser beams is guided to pass one or more optical fibers and monitoring air environments and the other beam is guided to pass a standard air environment.

The main control unit gives a warning event when the laser beam intensity of the first detecting device is decreased more than a reference value and gives an emergent event when the second laser beam intensity of the second detecting device is decreased more than a reference value.

DETAILED DESCRIPTION OF THE PREFERRED EMBODIMENTS

Laser gas absorption spectroscopy is a gas component analysis method which measures changes of laser beam intensity absorbed by particular gases. Laser gas chromatography is a gas component analysis method which measures absorbed frequencies after passing laser beams of various frequencies into a certain space of matters or gases.

The present invention uses the principle of the laser gas chromatography. Since the laser beam selectively interacts with the first particular frequency absorbed by benzyl alcohol gas and the second particular frequency absorbed by BHT gas, early fire alarms are given step by step. Furthermore, the reliability of early fire alarms can be increased by employing mirrors to split a laser beam into two laser beams, wherein one beam passes a standard air environment while another passes a monitoring air environment.

The present invention can monitor remotely the specified area by employing optical fibers, total or half reflected mirrors. While conventional fire sensing systems by gas detectors can only monitor an inside area of an enclosed power distribution panel, the present invention is possible to warn an early fire initiation by monitoring remotely an electrical fire of a spatially separated distribution board or of the particular space where fire risk is high.

The present invention monitors the laser beam intensity change of absorbed frequencies by interacting with gases. Benzyl alcohol gas used for an organic solvent in electrical insulating materials and BHT gas used for an antioxidant of a polymer material are generated by a rise in temperature due to a fire.

Figure 1:
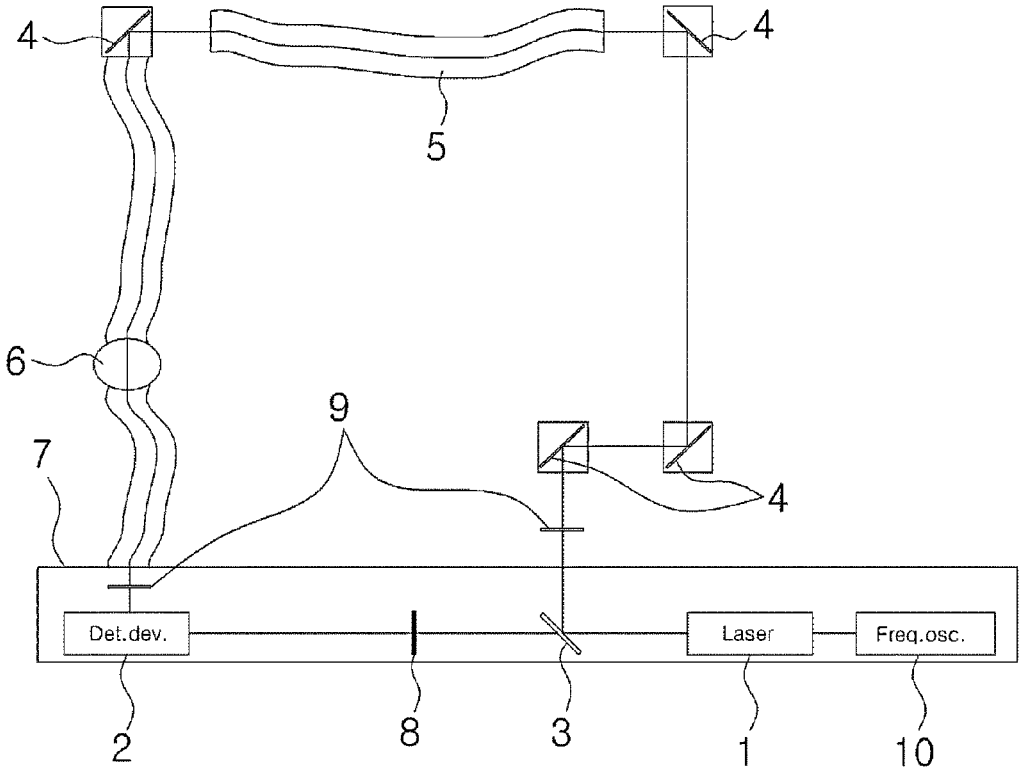
FIG. 1 illustrates a schematic diagram of the present invention.
Figure 2:
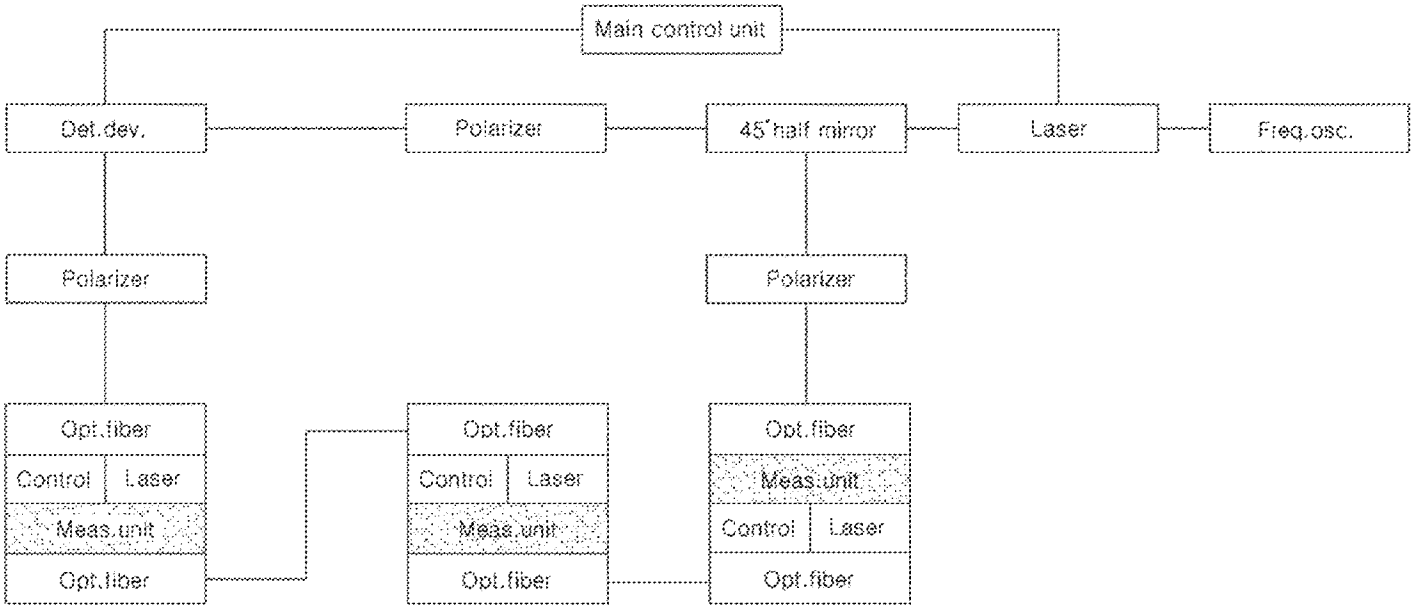
FIG. 2 illustrates a block diagram of the present invention.

FIG. 1 and FIG. 2 illustrates a schematic diagram and a block diagram of an early electrical fire alarm system, which includes a laser 1, a detecting device 2, a frequency oscillator, 45° half mirrors 3, optical fibers 5, an X-axis polarized lens 8, a Y-axis polarized lens 9, a standard air environment, a sealed tube 7 which contains all above, total reflection mirrors 4, and optical fibers 5.

The laser beam that passed through the 45° half mirror is guided to pass the X-axis polarized lens and a standard air environment in a sealed tube and is detected by the detecting device and is saved as the standard laser beam intensity.

The laser beam that reflected by the 45° half mirror is guided to pass a Y-axis polarized lens and one or more total mirrors and optical fibers and is detected by a detecting device and is saved as the measured laser beam intensity.

A main control unit compares two laser beam intensities and activates a warning alarm or an emergent alarm when the difference of two beam intensities is more than a reference value.

In one embodiment, the early electrical fire alarm system may comprise the first laser emitting the first frequency beam absorbed by benzyl alcohol gas; the second laser emitting the second frequency beam absorbed by BHT gas; a frequency oscillator for driving the first laser and the second laser; a sealed tube including the lasers, detecting devices, a frequency oscillator, 45° half mirrors, an X-axis polarized lens, and atmosphere as a standard air environment.

An early fire alarm step is given when the laser beam intensity difference of two laser beams that pass through different air environments is abnormal, wherein one air environment is a benzyl alcohol or BHT gas outside the sealed tube and another is the sealed standard air environment.

The 45° half mirror inside the sealed tube can split a laser beam into a 50% reflection beam and a 50% transmission beam.

The half transmitted laser beam by the 45° half mirror passes through both a polarized lens and the sealed standard air environment and is detected by the detecting device as the standard laser beam intensity.

An early fire warning event is given when the difference between the standard laser beam intensity and the measured laser beam intensity of an air environment outside a sealed tube is more than a reference value.

A main control unit consists of a microprocessor which gives an early fire warning event. The early fire warning event is given when the difference between the standard laser intensity and the laser beam intensity of the first and the second laser beam frequencies is more than a reference value.

The half reflected laser beam by the 45° half mirror is guided to pass one or more optical fibers and a monitoring air environment and a Y-axis polarized lens and is detected by the detecting device as the standard laser beam intensity.

Figure 3:
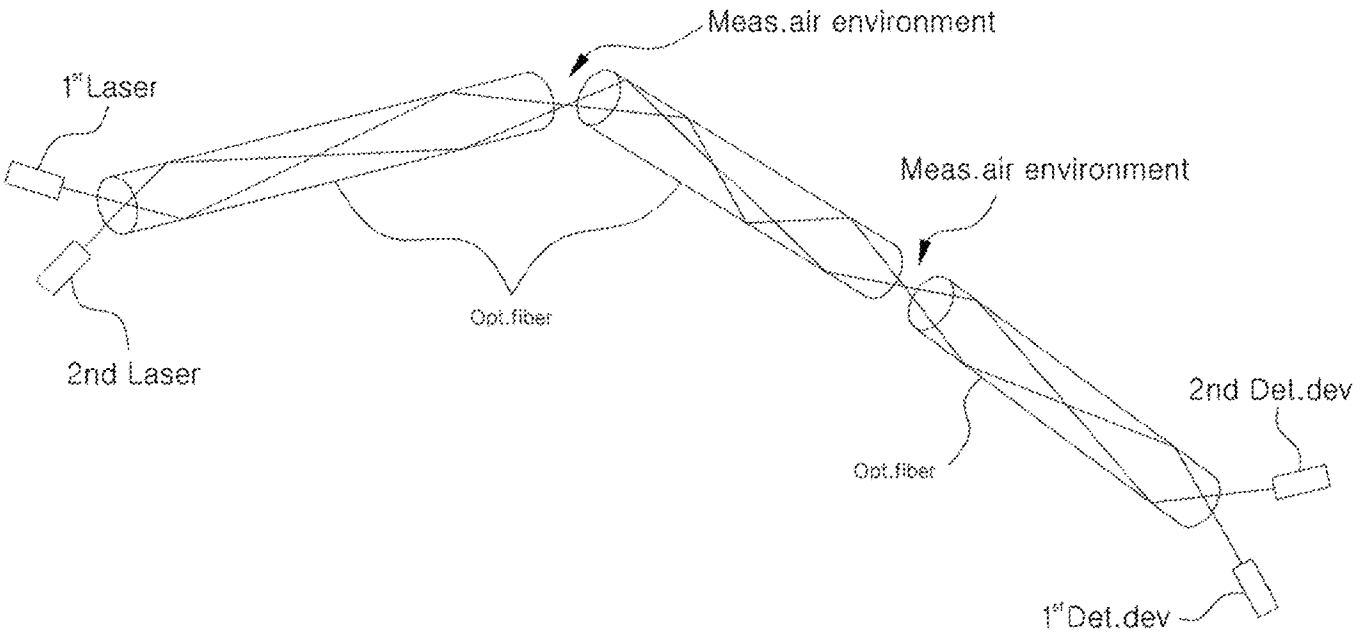
FIG. 3 illustrates a schematic diagram of the present invention.

FIG. 3 illustrates laser beam pathways passing one or more optical fibers and monitoring air environments. The laser beam passes through three optical fibers and two monitoring air environments between two laser beams and a detecting device.

In the present invention, the laser beam monitoring can be made by employing lasers and detecting devices. A sealed tube includes the first and the second lasers, the first and the second detecting devices, 45° half mirrors, and a standard air environment.

The first laser emits the first frequency beam absorbed by benzyl alcohol gas and is detected by the first detecting device. The second laser emits the second frequency beam absorbed by BHT gas and is detected by the second detecting device The 45° half mirror splits an output beam of the first and the second laser inside the sealed tube into a 50% reflection beam and a 50% transmission beam.

The laser beams of the first and the second lasers are half transmitted by the 45° half mirror and are passed through a standard air environment inside the sealed tube and are detected by the first and the second detecting devices and are transmitted as a standard laser beam intensity to a main control unit.

The laser beams of the first and the second lasers are half reflected by a 45° half mirror and the laser beams pass through one or more optical fibers and one or more the monitoring air environment and are detected by the first and the second detecting devices and are transmitted as a monitored laser beam intensity to the main control unit.

The main control unit gives a fire warning alarm event when the laser beam intensity difference between the first laser beam intensity of a standard air environment and the first detecting beam intensity of the first detecting device is more than a reference value, while a fire emergent alarm event when the laser beam intensity difference between the second laser beam intensity of a standard air environment and the second detecting beam intensity of the second detecting device is more than a reference value.

In the present invention, an early electrical fire alarm system comprises the first laser emitting as the first frequency beam absorbed by benzyl alcohol gas and the first detecting device detecting the first laser beam intensity; the second laser emitting as the second frequency beam absorbed by BHT gas and the second detecting device detecting the second laser beam intensity; and a main control unit consisting of a microprocessor, wherein the laser beam can be monitored using a reference value instead of measuring the standard air environment in a sealed tube.

The monitoring procedure is as follows. The first and the second laser beams pass through one or more optical fibers and a monitoring air environment and are detected by the first and the second detecting devices, respectively. A fire warning event is given when the first detected laser beam intensity of the first laser is decreased more than a reference value, while a fire emergent event is given when the second detected laser beam intensity of the second laser is decreased more than a reference value.

Figure 4:
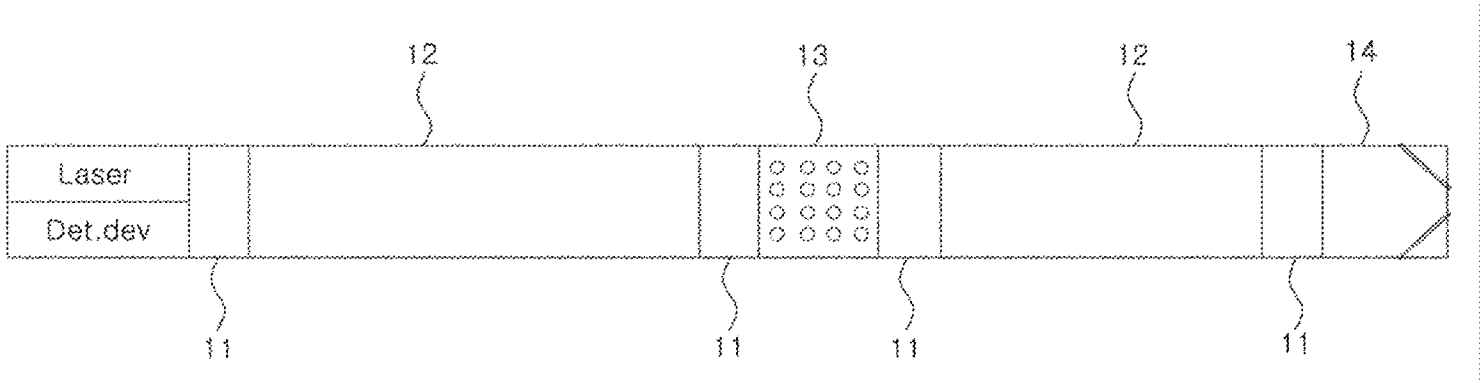
FIG. 4 illustrates a schematic diagram of the present invention.

FIG. 4 illustrates an early electrical fire alarm system according to the present invention, which uses sealed tubes 12, vent tubes 13, reflection tubes 14, and connectors 11 instead of optical fibers.

The first laser emits the first frequency beam absorbed by benzyl alcohol gas and is detected by the first detecting device and the second laser emits the second frequency beam absorbed by BHT gas and is detected by the second detecting device.

A main control unit including a microprocessor gives a fire warning event when the detecting laser beam intensity is decreased more than a reference value.

An electrical fire sensing system comprises: the first and the second laser beams passing a sealed tube and the monitoring air environment inside a sealed tube and the laser beams being reflected by a mirror inside a reflection tube and being detected by the first and the second detecting device; and a main control unit giving a fire warning event when the measured laser beam intensity of the first frequency is decreased more than a reference value, while a fire emergent event when the measured laser beam intensity of the second frequency is decreased more than a reference value.

The sealed tube with a vacuum or a standard air environment does not attenuate the first and the second laser beam intensity.

The vent tube is installed at the detection part and benzyl alcohol and BHT gases flows into the vent tube. Thus it is possible to detect the early electrical fire initiation at a specific site by detecting intensity of the laser beam passed through the vent tube.

The laser beam that reflected by the inside mirror of the reflection tube is detected by the detecting device. That makes possible to detect the early electrical fire initiation at a specific site by detecting the laser beam intensity change near the vent tube where benzyl alcohol and BHT gases come out.

Figure 5:
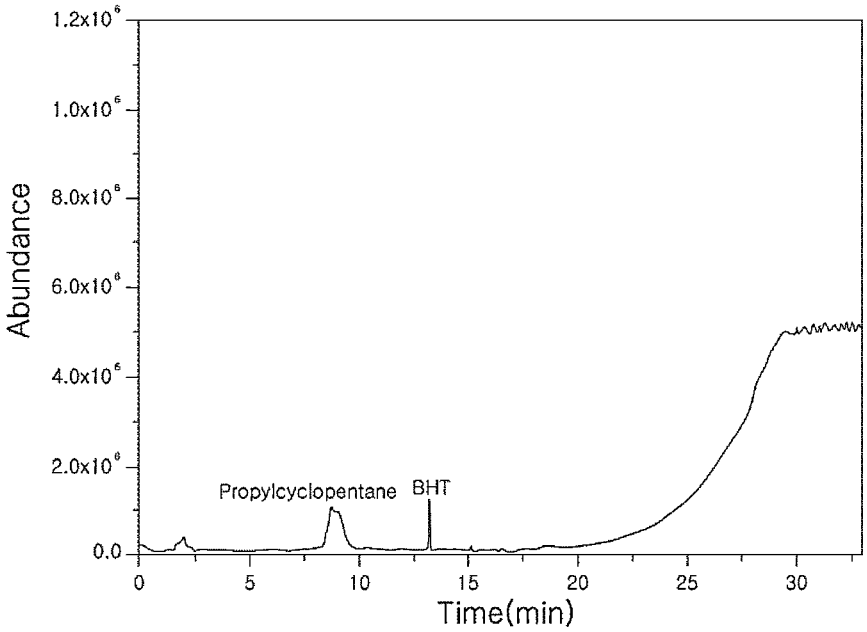
FIG. 5 shows a total ion chromatogram (TIC) of aged electrically-insulated wires at 80° C.
Figure 6:
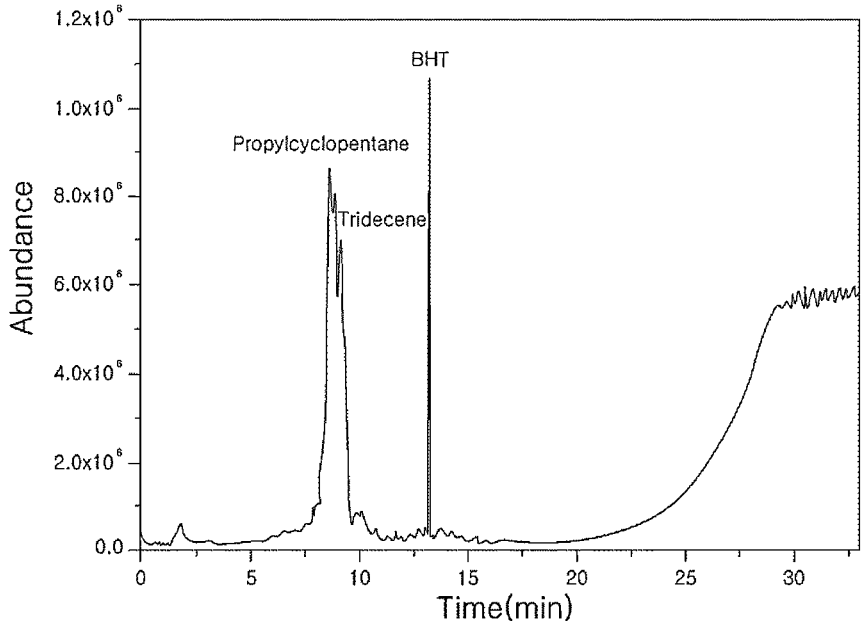
FIG. 6 shows a total ion chromatogram (TIC) of aged electrically-insulated wires at 100° C.

FIGS. 5 and 6 are total ion chromatograms (TIC) of aged electrically-insulated wires at 80° C. and 100° C., which show the abundance of BHT gases as a function of time.

In the present invention, a light emitting diode and a detecting diode device may be used for a laser and a detecting device.

In the present invention, optical fibers may be used for half mirrors, mirrors, or sealed tubes.

In the present invention, sealed tubes may be used for optical cables.

In the present invention, detecting device consists of two devices detecting the laser beams which are transmitted and reflected, respectively, or a single device which consists of two detection parts.

What is claimed is:

1. An early electrical fire sensing system for a high voltage panel, a low voltage panel, a motor control panel, a distribution board, or a power distribution panel comprising:

a laser generating a first frequency laser beam absorbed by benzyl alcohol gas and a second frequency laser beam absorbed by BHT gas;

a frequency oscillator alternatively generating a first frequency and a second frequency and driving the laser, the first frequency and the second frequency of the frequency oscillator corresponding respectively to the first frequency laser beam and the second frequency laser beam of the laser;

a sealed tube including the laser, a detecting diode, the frequency oscillator, a 45° half mirror, an X-axis polarizer, and a standard air environment; and a main controller including a microprocessor which determines alarm events, wherein half of the laser beam is transmitted by the 45° half mirror, passes through the standard air environment inside the sealed tube, and the X-axis polarizer and is detected by the detecting diode;

half of the laser beam is reflected by the 45° half mirror, passes through one or more optical fibers and one or more monitoring air environments, and is detected by the detecting diode, and the main controller determines a fire alarm event when a laser beam intensity difference between the first frequency reflected laser beam that is passed through the monitoring air environment and the first frequency transmitted laser beam that is passed through the standard air environment is more than a first reference value, and determines a fire emergent alarm event when the laser beam intensity difference between the second frequency reflected laser beam that is passed through the monitoring air environment and the second frequency transmitted laser beam that is passed through the standard air environment is more than a second reference value.

2. An early electrical fire sensing system comprising:

a sealed tube including a laser, a detecting diode, a frequency oscillator, a 45° half mirror, an X-axis polarizer, and a standard air environment; and a main controller including a microprocessor, wherein the frequency oscillator alternatively generates a first frequency and a second frequency for driving of the laser, the laser generates a first frequency laser beam and a second frequency laser beam, the first frequency laser beam and the second frequency laser beam of the laser corresponding respectively to the first frequency and the second frequency of the frequency oscillator, a 45° half mirror inside the sealed tube splits the first frequency laser beam and the second frequency laser beam into a 50% reflection beam and a 50% transmission beam, half of the laser beam is transmitted by the 45° half mirror, passes through the standard air environment inside the sealed tube and the X-axis polarizer, and is detected by the detecting diode, half of the laser beam that half is reflected by the 45° half mirror, passes through one or more optical fibers and one or more monitoring air environments, and is detected by the detecting diode, and the main controller determines a fire alarm event when a laser beam intensity difference between the first frequency reflected laser beam that is passed through the monitoring air environment and the first frequency transmitted laser beam that is passed through the standard air environment is more than a first reference value, and determines a fire emergent alarm event when the laser beam intensity difference between the second frequency reflected laser beam that is passed through the monitoring air environment and the second frequency transmitted laser beam that is passed through the standard air environment is more than a second reference value.

3. An early electrical fire sensing system comprising:

a sealed tube including a first laser, a second laser, a first detecting diode, a second detecting diode, 45° half mirrors, and a standard air environment; and a main controller consisting of a microprocessor, wherein the first laser emitting the emits a first frequency laser beam absorbed by benzyl alcohol gas, and the first detecting diode senses a first laser beam intensity, the second laser emits a second frequency laser beam absorbed by BHT, and the second diode senses a second laser beam intensity, the first 45° half mirror is located inside the sealed tube and splits the first frequency laser beam and the second frequency laser beam into a 50% reflection beam and a 50% transmission beam, wherein the portions of the first frequency laser beam and the second frequency laser beam that are transmitted by the first 45° half mirror pass through the standard air environment of the sealed tube and are detected by the first laser beam's detecting diode and the second laser beam's detecting diode as a first standard laser beam intensity and a second standard laser beam intensity and are transmitted to the main controller, the laser beams of the first laser and the second laser that are half reflected by the 45° half mirror pass through one or more optical fibers and one or more monitoring air environments and are detected by the first detecting diode and the second detecting diode as externally-monitored laser beam intensity and a second externally monitored laser beam intensity and are transmitted to the main controller, and the main controller control unit determines a fire alarm event when the laser beam intensity difference between the first frequency reflected laser beam that is passed through the monitoring air environment and the first frequency transmitted laser beam that is passed through the standard air environment is more than a first reference value, and determines a fire emergent alarm event when the laser beam intensity difference between the second frequency reflected laser beam that is passed through the monitoring air environment and the second frequency transmitted laser beam that is passed through the standard air environment is more than a second reference value.

4. An early electrical fire sensing system comprising:

a first laser emitting first frequency laser beam absorbed by benzyl alcohol gas, and a first detecting diode sensing a first laser beam intensity;

a second laser emitting a second frequency laser beam absorbed by BHT, and a second detecting diode sensing a second laser beam intensity; and a main controller including microprocessor, wherein the laser beams of the first laser and the second laser pass through one or more optical fibers and monitoring air environments and are detected by the first detecting diode and the second detecting diode, and the main controller determines a fire alarm event when the laser beam intensity difference between the first frequency reflected laser beam that is passed through the monitoring air environment and the first frequency transmitted laser beam that is passed through the standard air environment is more than a first reference value, determines a fire emergent alarm event when the laser beam intensity difference between the second frequency reflected laser beam that is passed through the monitoring air environment and the second frequency transmitted laser beam that is passed through the standard air environment is more than a second reference value.

5. An early electrical fire sensing system comprising:

a first laser emitting a first frequency laser beam absorbed by benzyl alcohol gas, and a first detecting diode sensing a first laser beam intensity;

a second laser emitting with the a second frequency laser beam absorbed by BHT, and a second detecting diode sensing a second laser beam intensity;

sealed tubes which are filled with a standard air environment or which are vacuum;

a vent tube;

a reflection tube including reflectors;

connectors which assemble the sealed tubes, the vent tube and reflection tubes; and a main controller, wherein the first frequency laser beam and the second frequency laser beam each passes through the standard air environment or vacuum of the sealed tube and the monitoring air environment of the vent tube, the first frequency laser beam and second frequency laser beam are each reflected by a mirror inside the reflection tube and are detected by the first detecting diode and the second detecting diode devices, respectively, and the main controller determines a fire alarm event when the first monitored laser beam intensity is decreased by more than a first reference value, and determines a fire emergent alarm event when the second measured laser beam intensity is decreased by more than a second reference value.

* * * * *